US011561495B2

(12) United States Patent
Kasai et al.

(10) Patent No.: US 11,561,495 B2
(45) Date of Patent: Jan. 24, 2023

(54) PRESSING ROTATING MEMBER AND PRODUCTION METHOD THEREOF, FIXING APPARATUS, AND ELECTROPHOTOGRAPHIC IMAGE FORMING APPARATUS

(71) Applicant: CANON KABUSHIKI KAISHA, Tokyo (JP)

(72) Inventors: Naoko Kasai, Kanagawa (JP); Yohei Miyauchi, Tokyo (JP); Yasuharu Notoya, Tokyo (JP); Takuji Oishi, Kanagawa (JP); Yasuhiro Miyahara, Tokyo (JP); Masaaki Takahashi, Kanagawa (JP); Yusuke Baba, Kanagawa (JP); Hiroki Muramatsu, Tokyo (JP); Ryo Ishifuji, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/554,211

(22) Filed: Dec. 17, 2021

(65) Prior Publication Data

US 2022/0206420 A1 Jun. 30, 2022

(30) Foreign Application Priority Data

Dec. 25, 2020 (JP) ..... JP2020-217926
Nov. 30, 2021 (JP) ..... JP2021-194429

(51) Int. Cl.
*G03G 15/20* (2006.01)

(52) U.S. Cl.
CPC ..... *G03G 15/2053* (2013.01)

(58) Field of Classification Search
CPC ..... G03G 15/206; G03G 15/2017; G03G 15/2053
See application file for complete search history.

(56) References Cited

U.S. PATENT DOCUMENTS

| | | | |
|---|---|---|---|
| 6,546,223 | B2 | 4/2003 | Kishino et al. |
| 6,688,023 | B1 | 2/2004 | Gwen et al. |
| 6,952,553 | B2 | 10/2005 | Sakakibara et al. |
| 9,110,416 | B2 | 8/2015 | Uchiyama et al. |
| 9,152,110 | B2 | 10/2015 | Miura et al. |
| 9,164,450 | B2 | 10/2015 | Matsumoto et al. |
| 9,417,575 | B2 | 8/2016 | Miura et al. |

(Continued)

FOREIGN PATENT DOCUMENTS

| | | |
|---|---|---|
| EP | 0 313 023 A2 | 4/1989 |
| EP | 0 625 735 A1 | 11/1994 |

(Continued)

OTHER PUBLICATIONS

Extended European Search Report in European Application No. 21217386.8 (dated May 2022).

(Continued)

*Primary Examiner* — Thomas S Giampaolo II
(74) *Attorney, Agent, or Firm* — Venable LLP

(57) ABSTRACT

A pressing rotating member comprising a base layer, an elastic layer and a surface layer, in this order, the surface layer having pores, wherein when placing an observation region of 8 μm long×11 μm wide at a cross section of the surface layer in a thickness direction of the surface layer—a direction perpendicular to a circumferential direction of the pressing rotating member, a degree of orientation f of the pores observed in the observation region is 0.20 or higher, and an orientation angle Φ of the pores observed in the observation region is 0° to 10°.

10 Claims, 3 Drawing Sheets

(56) References Cited

U.S. PATENT DOCUMENTS

| | | | | |
|---|---|---|---|---|
| 10,379,464 | B2 | 8/2019 | Muramatsu et al. | |
| 10,739,712 | B2 | 8/2020 | Miyauchi et al. | |
| 10,901,354 | B2 | 1/2021 | Miyauchi et al. | |
| 10,983,466 | B2 | 4/2021 | Miyauchi et al. | |
| 11,137,707 | B2 | 10/2021 | Asaka et al. | |
| 11,181,856 | B2 | 11/2021 | Miyauchi et al. | |
| 2016/0018771 | A1* | 1/2016 | Arai | G03G 15/206 492/56 |
| 2018/0043656 | A1 | 2/2018 | Song et al. | |
| 2018/0244072 | A1* | 8/2018 | Tanaka | G03G 15/206 |
| 2020/0073295 | A1* | 3/2020 | Taguchi | G03G 15/2057 |
| 2020/0086282 | A1 | 3/2020 | Tezuka et al. | |
| 2020/0086283 | A1 | 3/2020 | Tezuka et al. | |
| 2020/0354533 | A1 | 11/2020 | Tuszynski et al. | |
| 2021/0003953 | A1 | 1/2021 | Miyauchi et al. | |
| 2021/0134534 | A1 | 5/2021 | Toshinari | |

FOREIGN PATENT DOCUMENTS

| | | | |
|---|---|---|---|
| JP | 2-187436 | A | 7/1990 |
| JP | 5-269944 | A | 10/1993 |
| JP | 7-242768 | A | 9/1995 |
| JP | 9-255807 | A | 9/1997 |
| JP | 11-227143 | A | 8/1999 |
| JP | 2006-305937 | A | 11/2006 |
| JP | 2006-308716 | A | 11/2006 |
| JP | 2014232208 | A | 12/2014 |
| JP | 2018-180488 | A | 11/2018 |
| JP | 2019-012171 | A | 1/2019 |
| JP | 2019-192749 | A | 10/2019 |
| JP | 2020-007678 | A | 1/2020 |
| JP | 2020-140185 | A | 9/2020 |
| WO | 90/08218 | A1 | 7/1990 |
| WO | 2018/116517 | A1 | 6/2018 |
| WO | 2019/181796 | A1 | 9/2019 |

OTHER PUBLICATIONS

Nobuyuki Otsu, "A Threshold Selection Method from Gray-Level Histograms," SMC-9, No. 1 IEEE T. Syst Man. Cyb. 62-66 (Jan. 1979).

* cited by examiner

PRESSING ROTATING MEMBER AND PRODUCTION METHOD THEREOF, FIXING APPARATUS, AND ELECTROPHOTOGRAPHIC IMAGE FORMING APPARATUS

BACKGROUND OF THE INVENTION

Field of the Invention

The present disclosure is aimed at providing a pressing rotating member and a production method thereof, a fixing apparatus, and an electrophotographic image forming apparatus.

Description of the Related Art

Examples of a fixing apparatus used in an electrophotographic image forming apparatus (hereafter "image forming apparatus") such as a copier or a laser printer include a fixing apparatus having a heating rotating member and a pressing rotating member disposed in pressure-contact with the heating rotating member. In such a fixing apparatus, paper holding thereon an unfixed toner image is introduced into a nip formed by the heating rotating member and the pressing rotating member, and the toner is heated and pressed, as a result of which the image becomes fixed to the paper. The pressing rotating member may be referred to as a pressure roller when having a roller shape, or as a pressure belt when having an endless belt shape.

Japanese Patent Application Publication No. 2014-232208 discloses a fixing pressing member in which the surface of a pressing member used as a pressing rotating member is made up of a layer that contains a fluororesin and hollow particles having an outer shell formed out of an inorganic material in an amount of 10 parts by weight or more relative to 100 parts by weight of the fluororesin.

The surface layer of the pressing member according to Japanese Patent Application Publication No. 2014-232208 contains a fluororesin, and is made porous by containing hollow particles; accordingly the pressing member can be expected to elicit the effect of suppressing adhesion of toner onto the member surface, and the effect of suppressing transfer of heat from a heating member towards the pressing member. Herein the thermal insulation of the pressing member has to be further improved given the demand for achieving a shorter first print out time (FPOT) in electrophotographic devices. It was surmised that a higher thermal insulation in the surface layer that makes up the surface (hereafter also referred to as "outer surface") of the pressing member in direct contact with the paper would be effective in terms of further shortening FPOT.

Therefore, the inventors addressed an approach of increasing the amount of hollow particles that are added into the surface layer of the pressing member according to Japanese Patent Application Publication No. 2014-232208, and increasing porosity through the use of hollow particles of large particle size. It was however found that, as a result, the strength of the surface layer of the pressing member decreases, and the surface layer may exhibit cracks or breakage upon prolonged use. The inventors therefore recognized the need for developing a technique aimed at achieving a pressing rotating member having a configuration that allows improving the thermal insulation of the surface layer of the pressing rotating member in accordance with a method other than incorporating hollow particles, for the purpose of further improving thermal insulation while maintaining the durability of the surface layer.

SUMMARY OF THE INVENTION

At least one of aspects of the present disclosure is directed to providing a pressing rotating member that is capable of exhibiting, at a high level, both surface layer durability and excellent thermal insulation. Another aspect of the present disclosure is directed to providing a fixing apparatus that contributes to shortening a first print out time. A further aspect of the present disclosure is directed to providing an image forming apparatus having a shorter first print out time than in conventional art. Yet another aspect of the present disclosure aims at providing a method for producing a pressing rotating member that is capable of exhibiting, at a high level, both surface layer durability and excellent thermal insulation.

According to one aspect of the present disclosure, there is provided a pressing rotating member comprising a base layer, an elastic layer and a surface layer, in this order, the surface layer having pores, when placing an observation region having 8 μm long×11 μm wide at a cross section of the surface layer in a thickness direction of the surface layer—a direction perpendicular to a circumferential direction of the pressing rotating member, and defining a degree of orientation of the pores observed in the observation region as f, and an orientation angle of the pores observed in the observation region as Φ, f and Φ satisfy the following relationships:

f is 0.20 or higher;

Φ is 0° to 10°.

According to another aspect of the present disclosure, there is provided a fixing apparatus, comprising the above pressing rotating member, a fixing belt, and heating means of the fixing belt.

According to further aspect of the present disclosure, there is provided an electrophotographic image forming apparatus, comprising the above fixing apparatus According to yet another aspect of the present disclosure, there is provided a method for producing a pressing rotating member having a base layer, an elastic layer and a surface layer, in this order, the surface layer having pores, wherein the method comprises the steps of:

(i) providing a resin tube produced in accordance with a cylindrical extrusion method;

(ii) obtaining a layered body of a substrate having an endless belt shape or roller shape, an elastic layer covering an outer peripheral surface of the substrate, and the resin tube covering an outer peripheral surface of the elastic layer;

(iii) immersing the layered body in a perfluoropolyether, to impregnate the perfluoropolyether into the resin tube; and (iv) removing the perfluoropolyether impregnated into the resin tube of the layered body obtained in the step (iii) with a solvent, and thereby forming the pores in the resin tube, to obtain the surface layer.

Further features of the present invention will become apparent from the following description of exemplary embodiments with reference to the attached drawings.

DESCRIPTION OF THE EMBODIMENTS

Further, in the present disclosure, the expression of "from XX to YY" or "XX to YY" indicating a numerical range means a numerical range including a lower limit and an upper limit which are end points, unless otherwise specified. When numerical value ranges are provided in stages, the upper limits and lower limits of the individual numerical value ranges may be combined in any combination.

In the present disclosure the term "longitudinal direction" denotes a direction perpendicular to the circumferential direction of a pressing rotating member.

The inventors conducted repeated studies aimed at obtaining a pressing rotating member that is capable of exhibiting, at a high level, both surface layer durability and excellent thermal insulation. As a result, the inventors found that heat conduction in the thickness direction of the surface layer can be reduced while drops in the strength of the surface layer can be curtailed, by orienting the pores in the surface layer so that a degree of orientation f and an orientation angle Φ of the pores, as observed in a cross section in the thickness of the surface layer—direction perpendicular to the circumferential direction of the pressing rotating member, exhibit specific values.

That is, the pressing rotating member according to one aspect of the present disclosure comprises a base layer, an elastic layer, and a surface layer, in this order, and the surface layer has pores.

Further, when placing an observation region having 8 μm long×11 μm wide at a cross section of the surface layer in a thickness direction of the surface layer—a direction perpendicular to a circumferential direction of the pressing rotating member, and defining a degree of orientation of the pores observed in the observation region as f, and an orientation angle of the pores observed in the observation region as Φ, f is 0.20 or higher, and Φ is from 0° to 10°.

Figure 2:
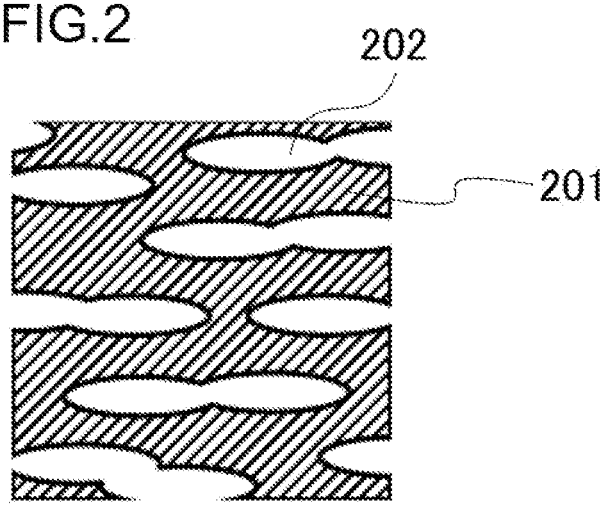
FIG. 2 is an observation image observed in a cross section, parallel to the longitudinal direction of a pressing rotating member described in Example 1, of a surface layer of the pressing rotating member.

In a case where the degree of orientation f and the orientation angle Φ of the pores observed in the observation region lie within the above ranges, the pores are present, in the surface layer, in layers in the longitudinal direction of the pressing rotating member (see FIG. 2). Such a configuration allows effectively blocking the flow of heat from a surface opposing the surface layer of the pressing rotating member, towards the base layer side of the pressing rotating member. As a result, it becomes possible to improve the thermal insulation of the surface layer in the thickness direction, while avoiding excessive increases in the porosity in the surface layer that give rise to drops in the strength of the surface layer.

One aspect of the pressing rotating member according to the present disclosure will be explained below.

1. Pressing Rotating Member

The pressing rotating member comprises a base layer, an elastic layer, and a surface layer, in this order.

Figure 3:
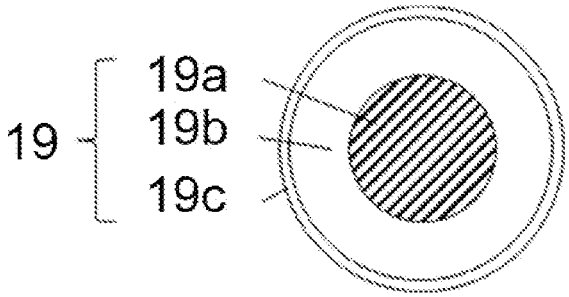
FIG. 3 is a cross-sectional schematic diagram of one aspect of a pressing rotating member.

FIG. 3 is a cross-sectional schematic diagram of one aspect of a pressing rotating member (hereafter referred to as "pressing rotating member 19"). The pressing rotating member 19 has a cylindrical or columnar base layer 19*a* and an elastic layer 19*b* that is formed as a cylindrical tube, concentrical with the base layer 19*a*, on the outer peripheral surface of the base layer 19*a*. The outer peripheral surface of the elastic layer 19*b* is covered with a surface layer 19*c* as an outermost layer. The elastic layer 19*b* may be bonded to the outer peripheral surface of the base layer 19*a* via an adhesive layer, not shown. The surface layer 19*c* may be bonded to the outer peripheral surface of the elastic layer 19*b* via an adhesive layer not shown.

The shape of the pressing rotating member is not particularly limited, and for instance the pressing rotating member may be a pressure belt having an endless belt shape or may be a pressure roller having a roller shape.

1-1. Base Layer

A substrate made of iron or aluminum is preferably used as the base layer 19*a*. The surface of the substrate may be activated beforehand by sandblasting or the like, or may be degreased with for instance methylene chloride, a hydrocarbon-based cleaning agent or an aqueous cleaning agent.

In a case where an elastic layer 19*b* containing silicone rubber is provided on the surface of the base layer 19*a*, it is preferable to perform a primer treatment on the surface of the base layer 19*a*, in order to improve adhesiveness between the base layer 19*a* and the elastic layer 19*b*.

Examples of primers used in primer treatments include coating materials in which a silane coupling agent, a silicone polymer, a hydrogenated methylsiloxane, an alkoxysilane, a reaction promoting catalyst and/or a colorant such as red iron oxide, are blended and dispersed as appropriate in an organic solvent.

The primer can be selected as appropriate depending on the material of the base layer 19*a*, the type of the elastic layer 19*b*, and the form of crosslinking reactions. A primer containing hydrosilyl groups is preferably used in a case in particular where the elastic layer 19*b* contains a large amount of unsaturated aliphatic groups, in order to impart adhesiveness derived from a reaction with the unsaturated aliphatic groups. A primer containing unsaturated aliphatic groups is preferably used in a case where the elastic layer 19*b* contains a large amount of hydrosilyl groups.

Other primers include those containing alkoxy groups. A commercial product can be used as the primer. The primer treatment includes a step of applying the primer onto the outer surface of the base layer 19*a* (surface bonded to the elastic layer 19*b*), with drying or baking.

A commercially available product can be used as the primer. Specifically, there can be used for instance a primer which is an equal mixture of "Liquid A" and "Liquid B" of DY35-051, by Dow Corning Toray Co., Ltd.

1-2. Elastic layer

The material of the elastic layer 19*b* is not particularly limited, and there can be used a known material utilized as an elastic layer in pressing rotating members. The elastic layer 19*b* is a layer for forming a fixing nip portion N described below in "2. Fixing apparatus", and may be a solid rubber layer or a foamed rubber layer. The thickness of the elastic layer 19*b* used in the pressing rotating member 19 is not particularly limited so long as a fixing nip portion N of desired width can be formed, but is preferably 2 mm to 10 mm.

Any of the following is preferably used as a main polymer of the elastic layer 19*b*. For instance, high-temperature vulcanizing (HTV) silicone rubber, addition reaction-curable (LTV; low-temperature-vulcanizing) silicone rubber, condensation reaction-curable (RTV; room-temperature-vulcanizing) silicone rubber, addition-type liquid silicone rubber, fluorocarbon rubber, and mixtures of the foregoing. Specifically, herein can be used a silicone rubber such as dimethyl silicone rubber, fluorosilicone rubber, methylphenyl silicone rubber or vinyl silicone rubber; or a fluorocarbon rubber such as vinylidene fluoride rubber, tetrafluoroethylene-propylene rubber, tetrafluoroethylene-perfluoromethylvinyl ether rubber, phosphazene-based fluorocarbon rubber, or fluoropolyether. A commercially available polymer can be used as the main polymer; specifically, a polymer can be used that is an equal mixture of "Liquid A" and "Liquid B" of DY35-1349SC by Dow Corning Toray Co., Ltd. These main polymers can be used singly as one type, or in combinations of two or more types.

A reinforcing filler such as carbon black, wet silica or dry silica, or an extender filler such as calcium carbonate or quartz powder, may be added to the main polymer, as needed.

An adhesive layer may be formed on the outer periphery of the elastic layer 19*b*. Although not limited thereto, an addition-curable silicone rubber adhesive such as an equal mixture of "Liquid A" and "Liquid B" of SE1819CV, by Dow Corning Toray Co., Ltd., can be used herein as the adhesive layer.

Further, the adhesive layer may be used concomitantly with an antistatic agent such as potassium pentafluoroethanesulfonate. When an antistatic agent is used concomitantly, the addition amount of the antistatic agent can be set to 0.1 parts by mass to 5 parts by mass relative to 100 parts by mass of the adhesive used in the adhesive layer.

The thickness of the adhesive layer formed on the outer periphery of the elastic layer 19*b* can set for instance to 0.5 μm to 20 μm.

1-3. Surface Layer

The surface layer 19*c* has pores. A degree of orientation f of pores of the surface layer 19*c* is 0.20 or higher, and an orientation angle Φ of the pores is from 0° to 10°, as observed at a region being 8 μm long×11 μm wide at a cross section in a thickness direction of the surface layer—longitudinal direction, i.e. direction perpendicular to a circumferential direction of the pressing rotating member.

The orientation angle Φ and the degree of orientation f of the pores calculated in accordance with the above method are parameters denoting the orientation direction and the degree of orientation, with respect to the longitudinal direction, of the pores within the surface layer.

1-3-1. Method of Calculating the Orientation Angle 1 and the Degree of Orientation f of the Pores in the Surface Layer From the pressing rotating member there is cut out a sample using a section preparation device (for instance, a Cryo-Ultra-microtome (product name: by Leica Microsystems GmbH)), so that a cross section in the thickness of the pressing rotating member—the longitudinal direction of the pressing rotating member appears on the surface of the sample. A portion of the cross section corresponding to the total thickness of the surface layer is polished using an ion beam, as needed. For instance, a cross-section polisher can be used for polishing the cross section obtained using an ion beam.

The cross section is then observed under a scanning electron microscope, and an image of a rectangular observation region (SEM image) that is 8 μm long×11 μm wide is acquired at a predetermined position of the cross section. Image acquisition is adjusted so that the longitudinal direction of the image is the thickness direction of the surface layer and the transversal direction of the image is parallel to the longitudinal direction of the pressing rotating member. The resolution is set (for instance to 717 pixels×986 pixels), so that the pores appearing in the cross section can be analyzed.

FIG. 2 is an enlarged schematic diagram of a part of the SEM image, where pores 202 are present within a resin portion 201 of the surface layer. The pores in the surface layer according to one aspect of the present disclosure and produced in accordance with below-described method do not have a shell, the walls of the pores being thus made up of the resin portion 201, as illustrated in FIG. 2.

The obtained SEM image is binarized, using numerical calculation software (product name: MATLAB; by The MathWorks, Inc.), to allow discriminating between two regions respectively corresponding to the resin portion 201 and the pores 202. Herein Otsu's method as disclosed in "IEEE Transactions on SYSTEMS, MAN, AND CYBERNETICS, vol. SMC-9, No. 1, January 1979, pp. 62-66" is resorted for binarization. Two-dimensional Fourier transform analysis is then performed, using the above numerical value calculation software, on the binarized image obtained as a result of the above binarization process, and the resulting power spectrum is integrated in each direction, to obtain a plot diagram (FIG. 1) representing the orientation of the pores.

The two-dimensional Fourier transform has a peak in the direction orthogonal to the periodicity of the image, and accordingly the 90° to 270° direction denotes the longitudinal direction of the surface layer in a case where the two-dimensional Fourier transform is applied to an image of a thickness-longitudinal cross section. In this plot, the angle (from 0° to 90°) formed by the longest diameter with respect to the 90° to 270° direction is taken as the orientation angle Φ. The closer the orientation angle Φ is to 0°, the greater the degree to which the pores are oriented in the longitudinal direction. That is, the orientation angle Φ is a parameter that represents the orientation of the pores relative to the longitudinal direction.

Figure 1:
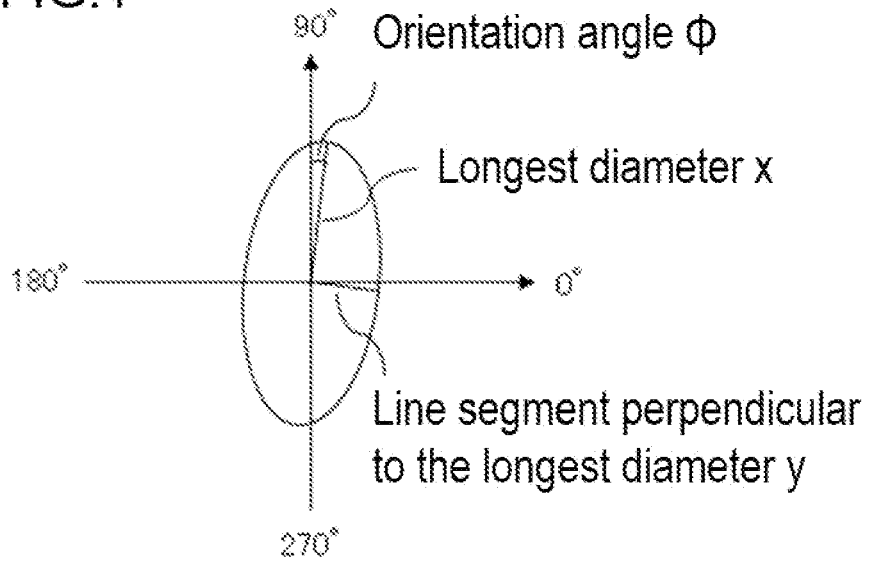
FIG. 1 is a schematic diagram illustrating a method for ascertaining a degree of orientation f and an orientation angle Φ of pores.

Further, the degree of orientation f is defined as $f=1-(y/x)$ where x denotes the length of a line segment having a longest diameter and y denotes the length of a line segment perpendicular to the longest diameter. FIG. 1 illustrates a method for ascertaining the orientation angle Φ and the degree of orientation f. The degree of orientation f takes on a value from 0.00 to less than 1.00. In the case of unoriented, completely random pores, the degree of orientation f is 0.00; that is, the degree of orientation f draws close to 1.00 as the degree of orientation of the pores increases. The degree of orientation is thus a parameter that denotes the degree of orientation of the pores in the longitudinal direction.

Acquisition of a SEM image from a cross section of the sample is performed at the prescribed three sites below. Specifically, a position such that the upper end of the observation region is positioned at 1 μm in the depth direction of the surface layer, from the outer surface thereof, constituting the outer surface of the pressing rotating member which in turn constitutes the contact surface with the heating rotating member within the fixing apparatus; a position such that the lower end of the observation region is positioned at 1 μm from the surface of the surface layer on the reverse side from that of the outer surface (i.e. at 1 μm from the surface on the side facing the base layer), towards the outer surface; and a position at which the central portion of the surface layer in the thickness direction matches the center of the observation region. In a case where the thickness of the surface layer is smaller than 26 the acquisition position is adjusted so that the observation regions do not overlap with each other. The orientation angle and the degree of orientation according to the present disclosure are set to average values of the respective values obtained from SEM images in respective observation regions acquired at the above three locations.

In the pressing rotating member according to one aspect of the present disclosure, the orientation angle Φ is 10° or smaller, preferably 7° or smaller, and more preferably 5° or smaller. The orientation angle Φ is 0° or larger, and may be for instance 1° or larger, or 2° or larger. That is, for example, a preferable range of the orientation angle Φ is 0° or larger and 10° or smaller, and more preferable range of the orientation angle Φ is 1° or larger and 7° or smaller, and yet preferable range of the orientation angle Φ is 2° or larger and 5° or smaller.

The degree of orientation f is 0.20 or higher, preferably 0.25 or higher, and more preferably 0.30 or higher. The upper limit of the degree of orientation f is not particularly restricted, and the higher the value, the more preferable the degree of orientation f is; for instance, the upper limit may be lower than 1.00, or may be 0.80 or lower, or 0.60 or lower. That is, for example, a preferable range of the degree of orientation f is 0.20 or higher and lower than 1.00, more preferable range off is 0.25 or higher and 0.80 or lower, and yet preferable range off is 0.30 or higher and 0.60 or lower.

When the orientation angle Φ in the longitudinal direction of the pores and the degree of orientation f take on the above values, it is possible to achieve a thermal insulation effect in the thickness direction of the surface layer derived from the orientation of the pores in the longitudinal direction.

A method for producing such a surface layer will be described further on.

The material of the surface layer 19*c* is not particularly limited, and a known material used as the surface layer of pressing rotating members can be utilized herein. Preferably, the surface layer comprises a fluororesin. This allows suppressing adhesion of toner to the surface of the pressing rotating member. In this case, the content ratio of the fluororesin in the surface layer is preferably 60 mass % or higher, in particular 80 mass % or higher, with respect to the surface layer. This is because in that case there is achieved a more pronounced effect, elicited by the fluororesin, of suppressing filming of the toner on the outer surface of the pressing rotating member. The upper limit of the content ratio is not particularly restricted, and is 100 mass % or less, and may be 95 mass % or less in terms of the presence of other optional components (conductive filler or the like) in the surface layer.

Examples of the fluororesin include a copolymer (hereafter PFA) of tetrafluoroethylene and perfluoroalkyl vinyl ether (hereafter PAVE). As the PAVE there can be suitably used, for instance, a PAVE has the perfluoroalkyl chain of which has 1 to 6 carbon atoms, in particular 1 to 4 carbon atoms, and further 1 to 3 carbon atoms. Concrete examples of the PAVE include for instance perfluoromethyl vinyl ether ($CF_2{=}CF{-}O{-}CF_3$), perfluoroethyl vinyl ether ($CF_2{=}CF{-}O{-}CF_2CF_3$) and perfluoropropyl vinyl ether ($CF_2{=}CF{-}O{-}CF_2CF_2CF_3$).

The following commercially available products can be used as such PFA.

"451HP-J", "959HP-Plus", "350-J" and "950HP-Plus" (all product names, by Chemours-Mitsui Fluoroproducts Co., Ltd.);

"P-66P", "P-66PT" and "P-802UP" (all product names, by AGC Inc.);

"AP-230", "AP-231SH" and the like (all product names, by Daikin Industries, Ltd.);

"6502N" (product name, by The 3M Company).

The melting point of PFA lies ordinarily in the range 280° C. to 320° C., for instance 290° C. to 310° C.

Method for Producing a Pressing Rotating Member

A non-limiting exemplary method for producing a pressing rotating member (pressure belt or pressure roller) according to one aspect of the present disclosure having a base layer, an elastic layer and a surface layer, in this order, and wherein the surface layer has pores, includes for instance a method having steps (i) to (iv) below.

(i) Step of providing a resin tube (hereafter, also referred to as "cylindrically extruded resin tube") produced in accordance with a cylindrical extrusion method.

(ii) Step of obtaining a layered body of a substrate having an endless belt shape or roller shape, an elastic layer covering the outer peripheral surface of the substrate and the cylindrically extruded resin tube covering the outer peripheral surface of the elastic layer;

(iii) Step of immersing the layered body in a perfluoropolyether heated up to a temperature near the melting point of the resin tube, to impregnate the perfluoropolyether (PFPE) into the resin tube;

(iv) Step of removing the PFPE impregnated into the resin tube of the layered body obtained in the step (iii) with a solvent and thereby forming the pores in the resin tube.

Studies by the inventors have revealed that by impregnating a cylindrically extruded resin tube with PFPE, which is a liquid, and removing thereafter the PFPE, pores can be formed that have a predetermined orientation angle and a predetermined degree of orientation within the resin tube.

Conceivable reasons why the above method allows forming, within the resin layer, pores oriented to a certain degree in a direction perpendicular to the circumferential direction of the pressing rotating member, are deemed to include the following. An instance where a PFA tube obtained through cylindrical extrusion of PFA is used as the resin tube will be explained hereafter as an example. However, the resin tube according to the present disclosure is not limited to a PFA tube.

A layered body made up of a substrate having an endless belt shape or roller shape, an elastic layer covering the outer peripheral surface of the substrate, and a PFA tube covering the outer peripheral surface of the elastic layer, is immersed in PFPE heated to a temperature (temperature of 300° C.±50° C. (preferably 290° C. to 325° C.) near the melting point of PFA, and the heated PFPE is brought into contact with the outer peripheral surface of the PFA tube, to thereby cause the PFPE to permeate into the PFA tube. As the amount of PFPE within the PFA tube increases, a state of aggregated/connected PFPE is brought about within the PFA tube. Aggregation/connection of PFPE are deemed to take place preferentially in the amorphous region of PFA. If the amorphous region of PFA is oriented, then also the region of PFPE is accordingly formed while oriented in the orientation direction of the amorphous region. In the PFA tube formed by cylindrical extrusion, the amorphous region is oriented in a direction parallel to the extrusion direction, i.e. a direction perpendicular to the circumferential direction of the PFA tube. In a case where the cylindrically extruded PFA tube is impregnated with PFPE, therefore, the PFPE region becomes oriented in a direction perpendicular to the circumferential direction of the PFA tube.

Thereafter, the PFPE within the PFA tube is removed using a solvent, as a result of which pores become formed in the portions of the PFA tube at which the PFPE was present. In consequence, pores oriented in the direction perpendicular to the circumferential direction of the PFA tube are formed within the PFA tube. Studies by the inventors have revealed that the smaller the thickness of the resin tube, the higher can be made the degree of orientation f of the pores, and the closer the orientation angle Φ can be brought to zero. A conceivable underlying reason for the above is the fact that the thinner the cylindrically extruded resin tube is, the more readily the amorphous region becomes oriented in a direction parallel to the extrusion direction.

In the present disclosure, the thickness of the resin tube can be selected as appropriate so long as the degree of orientation f and the orientation angle Φ according to the present disclosure are achieved; however, a value of resin tube thickness that allows herein the pores to be oriented in the extrusion direction is preferably 12 μm to 100 μm, more preferably 20 μm to 50 μm.

In terms of the preferred amount of pores in the resin layer, described below, the perfluoropolyether is preferably impregnated into the resin tube in such a manner that the impregnation amount of the perfluoropolyether into the resin tube in step (iii) is 25 mass % to 60 mass %, in particular 30 mass % to 45 mass %, relative to the mass of the resin tube after having been impregnated with the perfluoropolyether.

The vicinity of the melting point of the resin tube in step (iii) includes for instance a range of Tm±50 (° C.), where Tm (° C.) is the melting point of the resin tube. In a case where the resin tube is a PFA tube, the Tm of the PFA lies within the range of 280 to 320° C., and accordingly the temperature of the PFPE brought into contact with the outer surface of the resin tube in step (iii) is for instance 250° C. to 350° C., preferably 290° C. to 325° C.

The higher the temperature of the PFPE and the lower the viscosity of the PFPE in step (iii), the greater the degree to which the impregnation amount of PFPE into the resin tube can be increased. The contact time between the outer peripheral surface of the resin tube and the PFPE varies depending on the viscosity of the PFPE impregnated into the resin tube and the impregnation amount; as a guide, however, the contact time ranges 20 seconds to 5 minutes, and in particular 30 seconds to 2 minutes. Over a lapse of time within this range, the resin tube can be impregnated with a sufficient amount of PFPE that allows forming pores within the resin tube. Any method can be resorted to as the contact method between the resin tube and the PFPE in the production of the pressing rotating member in step (iii), so long as the PFPE can be brought into contact with the outer peripheral surface of the resin tube at a temperature near the melting point of the resin tube.

Contact between the outer peripheral surface of the resin tube and the PFPE may be accomplished in a state in which the base layer, the elastic layer, and the surface layer have been laid up beforehand to yield a layered body; alternatively, contact may be performed in a state where the surface (inner peripheral surface) of the resin tube, on the side of contact with the elastic layer, is masked. The foregoing can be produced by resorting for instance to a dipping method as the contact method.

In step (iv) the layered body resulting from impregnating the resin tube with PFPE is retrieved from a perfluoropolyether bath, is cooled down to room temperature, and then the PFPE impregnated into the resin tube is removed using a fluorosolvent. Pores become formed within the resin tube as a result of this operation.

The layered body may be simply immersed in a fluorosolvent; in order to remove PFPE from the resin tube more efficiently, however, it is preferable to apply ultrasounds and/or heat up the fluorosolvent.

A solvent capable of dissolving PFPE but not the resin that makes up the resin tube is preferably used as the fluorosolvent. The term "solvent that dissolves PFPE" encompasses be, for instance solvents such that the dissolution amount of PFPE in 100 g of the solvent at 25° C. is 10 g or greater. Meanwhile, the term "solvent which does not dissolve PFA" encompasses solvents such that the dissolution amount of PFA in 100 g of the solvent at 25° C. is 1 g or smaller.

Hydrofluoroethers dissolve PFPE, in a case for instance where the resin tube is a PFA tube. By contrast, PFA hardly dissolves in hydrofluoroethers, and accordingly a hydrofluoroether is thus a preferred fluorosolvent herein. For instance, a commercially available hydrofluoroether such as "Novec 7300" (product name, by The 3M Company) can be used as the hydrofluoroether.

In the surface layer according to the present disclosure an arithmetic mean value (hereafter "pore area ratio") of the ratio of the sum total of the surface areas of pores relative to the surface area (having the pores) of an observation region that is 8 μm long×11 μm wide, in a binarized image used for calculating the orientation angle Φ and the degree of orientation f, is preferably from 15% to 50%, more preferably from 25% to 45%. Setting a pore area ratio within the above ranges allows achieving, at a higher level, both strength in the pressing rotating member according to the present disclosure and thermal insulation in the thickness direction.

To achieve such a pore area ratio, described above, it is preferable to impregnate the resin tube with a sufficient amount of PFPE in step (iii). The impregnation amount of PFPE into the resin tube can be adjusted for instance on the basis of the temperature of the PFPE that is brought into contact with the outer peripheral surface of the resin tube, and the viscosity of the PFPE. Specifically, the impregnation amount of PFPE into the resin tube can be increased by raising the temperature of the PFPE that is brought into contact with the outer peripheral surface of the resin tube. The impregnation amount of PFPE into the resin tube can be increased by using a low-viscosity PFPE. In the case of PFPE of excessively low viscosity, however, a PFPE region derived from aggregation/connection within the resin tube does not form readily, and a high pore surface area ratio may be difficult to achieve, ostensibly on account of the increased affinity towards PFA.

The surface layer is preferably a single-layer film. The thickness of the surface layer is preferably 12 μm or larger, more preferably 20 μm or larger, and preferably 100 μm or smaller, and more preferably 50 μm or smaller, in terms of making it easy to adjust the orientation angle Φ and the degree of orientation f of the pores so as to lie within the ranges of the present disclosure, and in terms of the durability of the pressing rotating member. The thickness of the surface layer can be set for instance to range from 12 μm to 100 μm.

Perfluoropolyether (PFPE)

The perfluoropolyether is not particularly limited, so long as it can be impregnated into the resin tube, and known perfluoropolyethers can be used herein. Preferably, the PFPE has a structure represented by the formula below. The PFPE is preferably oily at the melting point of PFA.

(1)

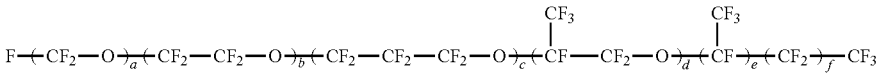

In Formula (1), a, b, c, d, e and f are each independently 0 or a positive integer, satisfy $1 \leq a+b+c+d+e+f \leq 600$, and at least one from among a, b, c and d represents a positive integer.

Further, the order in which each repeating unit is present in Formula (1) is not limited to the order described above. Further, each repeating unit in Formula (1) may be present at a plurality of sites in the PFPE. That is, the PFPE represented by Formula (1) may be a block copolymer or a random copolymer.

Specifically, the perfluoropolyether preferably has at least one structure selected from the group consisting of Formulas (2) to (5) below.

(2)

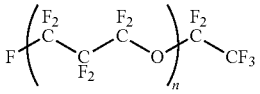

In Formula (2), n is a positive number, n lying in a range such that PFPE viscosity at a temperature of 40° C. ranges 30 mPa·s to 400 mPa·s.

(3)

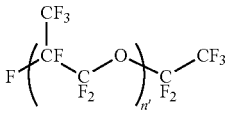

In Formula (3), n' is a positive number, n' lying in a range such that the PFPE viscosity at a temperature of 40° C. ranges 10 mPa·s to 400 mPa·s.

(4)

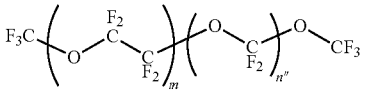

In Formula (4), n" and m are each independently a positive number, m/n" is a number from 0.5 to 2, and n"+m is a number lying in a range such that the PFPE viscosity at a temperature of 40° C. ranges 20 mPa·s to 400 mPa·s.

(5)

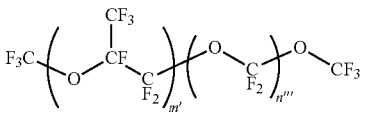

In Formula (5), n'" and m' are each independently a positive number, m'/n'" is a number from 20 to 1000, and n'"+m' is a number lying in a range such that the PFPE viscosity at a temperature of 40° C. ranges 20 mPa·s to 400 mPa·s.

From the viewpoint of good impregnation into the resin tube, the PFPE viscosity at a temperature of 40° C. ranges preferably 10 mPa·s to 400 mPa·s, more preferably 30 mPa·s to 350 mPa·s. As used herein, the term viscosity denotes a value measured after 60 seconds of rotation at a shear velocity of 100 $s^{-1}$, and at a measurement temperature of 40° C. using a dynamic viscoelasticity measuring device (rheometer) that utilizes a cone plate having a cone angle of 1° and a cone radius of 20 mm. Examples of the rheometer include for instance "DHR-2" (product name, by TA Instruments Inc.).

Examples of commercially available PFPE include, for instance, a PFPE having the structure represented by Formula (2) (for instance Demnum S-200 and Demnum S-65 (both product names); by Daikin Industries, Ltd.), PFPE having the structure represented by Formula (3) (for instance Krytox GPL-105, Krytox GPL-104, Krytox GPL-103, Krytox GPL-102 and Krytox GPL-101 (all product names); by The Chemours Company), PFPE having the structure represented by Formula (4) (for instance Fomblin M07 and Fomblin M15 (both product names); by Solvay Specialty Polymers Co., Ltd.), and PFPE represented by Formula (5) (for instance Fomblin Y15 and Fomblin Y25 (both product names); by Solvay Specialty Polymers Co., Ltd.).

For instance, "Demnum S-200" has a viscosity of 377 mPa·s, "Krytox GPL-105" has a viscosity of 301 mPa·s, "Krytox GPL-104" has a viscosity of 111 mPa·s, "Krytox GPL-103" has a viscosity of 54 mPa·s, "Krytox GPL-102" has a viscosity of 26 mPa·s, and "Krytox GPL-101" has a viscosity of 12 mPa·s. The above values of viscosity all denote viscosity at a temperature of 40° C.

2. Fixing Apparatus

The fixing apparatus includes a pressing rotating member described as the above pressing rotating member, a fixing belt, and a heating means of the fixing belt.

Figure 4:
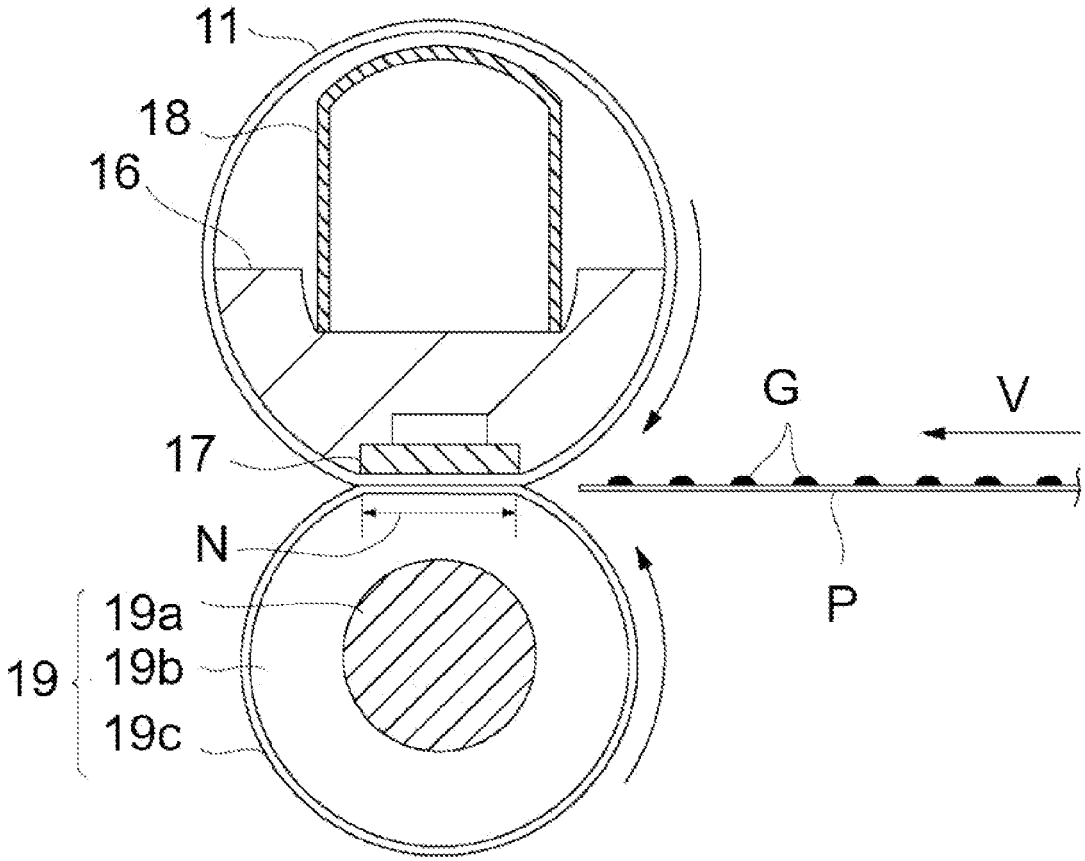
FIG. 4 is a cross-sectional schematic diagram of one aspect of a fixing apparatus that utilizes a pressing rotating member.

FIG. 4 is a schematic diagram illustrating a cross section in an example of a schematic configuration of a fixing apparatus of belt heating type.

The fixing belt 11 is loosely fitted to a belt guide member 16. A pressing rigid stay 18 is inserted inward of the belt guide member 16. The belt guide member 16 is formed of for instance a heat-resistant/heat-insulating resin.

The heating means is for instance a heater arranged in contact with the inner peripheral surface of the fixing belt. A ceramic heater 17 as a heat source is provided at a position at which the belt guide member 16 and the inner surface of the fixing belt 11 are in contact with each other. The ceramic heater 17 is fitted to and fixed in a groove provided along the longitudinal direction of the belt guide member 16. The ceramic heater 17 generates heat through energization by a means not shown.

The roller-shaped pressing rotating member 19 is a pressing rotating member described as the above pressing rotating member. A push-down force is exerted on the pressing rigid stay 18 by arranging pressure springs (not shown) between both ends of the pressing rigid stay 18 and spring receiving members (not shown) on the apparatus chassis side. As a result, the lower face of the ceramic heater 17 disposed on the lower face of the belt guide member 16 and the top face of the pressing rotating member 19 are pressed against each other, with the fixing belt 11 nipped in between, to form a predetermined fixing nip portion N. That is, the lower face of the ceramic heater 17 is disposed in contact with the inner peripheral surface of the fixing belt 11.

A recording medium P as a body to be heated having formed thereon an image by unfixed toner G is nipped and transported in the fixing nip portion N at a transport speed V. The toner image is heated and pressed as a result. In consequence the toner image melts, with color mixing; thereafter, the toner image is cooled, whereby a toner image becomes fixed on the recording medium P.

Also a method other than the belt heating-type method as in the present example, for instance a thermal roller method, can elicit the same effect, by resorting herein to a structure having the pressing rotating member described as the above pressing rotating member.

3. Image Forming Apparatus

A known configuration can be adopted as the image forming apparatus. Such apparatuses include multifunction devices, copiers, fax machines and printers that utilize an electrophotographic system. The overall structure of an image forming apparatus will be explained schematically herein using a color laser printer as an example.

Figure 5:
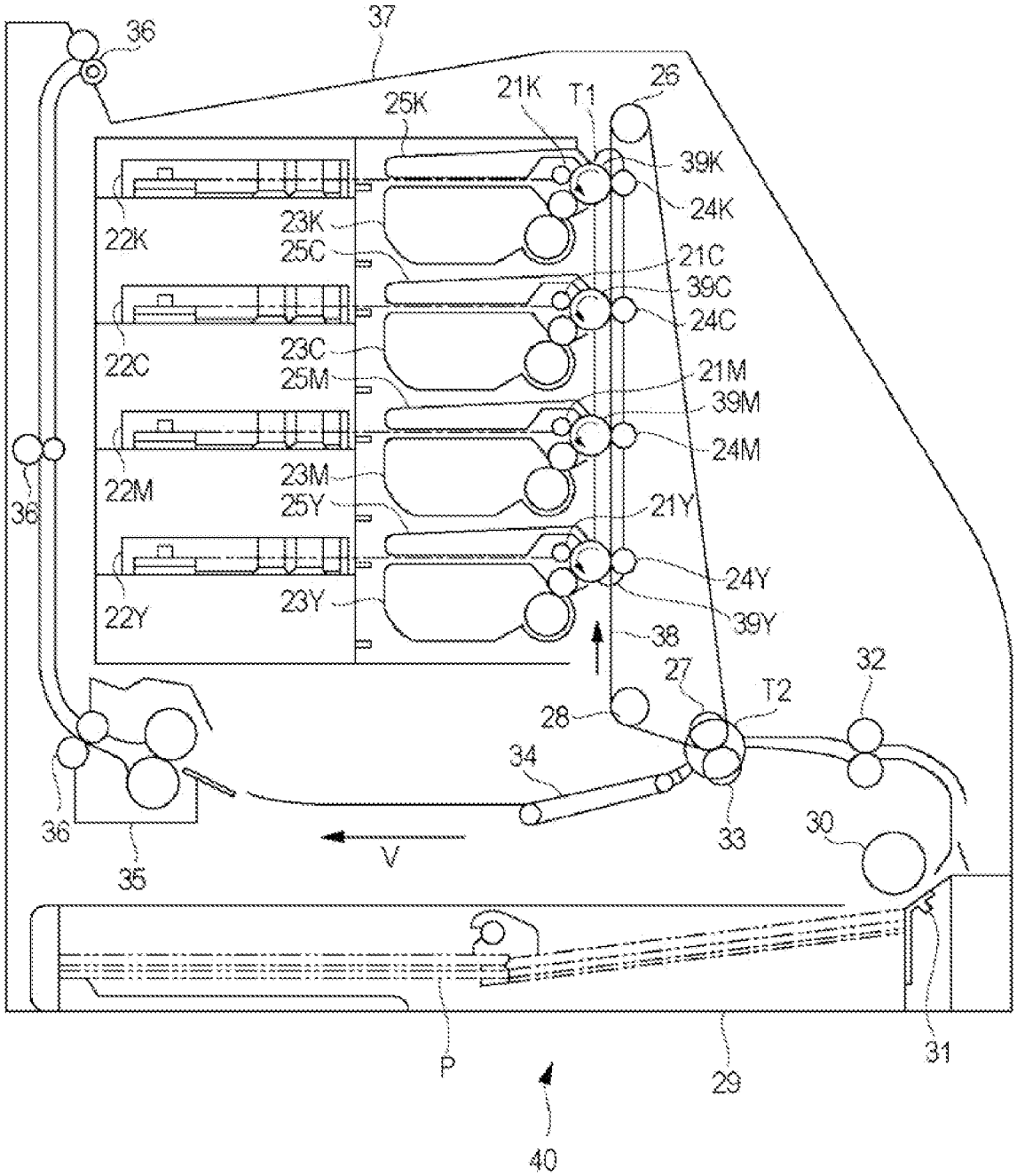
FIG. 5 is a schematic diagram illustrating one aspect of an electrophotographic image forming apparatus.

FIG. 5 is a schematic cross-sectional diagram of a laser printer 40. The laser printer 40 illustrated in FIG. 5 has respective electrophotographic photosensitive member drums 39 (hereafter referred to as "photosensitive member drums 39") that rotate at a constant speed for each respective color including yellow (Y), magenta (M), cyan (C) and black (K). The laser printer 40 further has an intermediate transfer member 38 which holds a color image, developed at an image forming section and resulting from multiple transfer, and which transfers the color image to the recording medium P that is fed from a feeding unit.

Each photosensitive member drum 39 (39Y, 39M, 39C, 39K) is rotationally driven counterclockwise, as illustrated in FIG. 5, by a driving means (not shown).

Around each photosensitive member drum 39 there are sequentially disposed, according to the rotation direction thereof, a respective charging device 21 (21Y, 21M, 21C, 21K) that charges uniformly the surface of the photosensitive member drum 39, a respective scanner unit 22 (22Y, 22M, 22C, 22K) that projects a laser beam, on the basis of image information, to form an electrostatic latent image on the photosensitive member drum 39, a respective developing unit 23 (23Y, 23M, 23C, 23K) that causes toner to adhere onto the electrostatic latent image, to thereby develop the toner in the form of a toner image, a respective primary transfer roller 24 (24Y, 24M, 24C, 24K) that transfers the toner image on the photosensitive member drum 39 to the intermediate transfer member 38, at a primary transfer section T1, and a respective cleaning unit 25 (25Y, 25M, 25C, 25K) having a cleaning blade that removes untransferred toner remaining on the surface of the photosensitive member drum 39 after transfer.

At the time of image formation, the belt-shaped intermediate transfer member 38 spanned around rollers 26, 27 and 28 rotates and the color toner images formed on respective photosensitive member drums 39 undergo primary transfer, superimposed on each other, onto the intermediate transfer member 38, so that a color image is formed as a result.

The recording medium P is then transported to a secondary transfer section T2 by a transport means, in synchrony with primary transfer to the intermediate transfer member 38. The transport means includes a feed cassette 29 that accommodates a plurality of sheets of the recording medium P, a feed roller 30, a separation pad 31, and a resist roller pair 32. At the time of image formation, the feed roller 30 is rotationally driven in accordance with an image forming operation, and the recording medium P in the feed cassette 29 is separated sheet by sheet, and is transported by the resist roller pair 32 to the secondary transfer section T2 at a timing synchronized with the image formation operation.

A movable secondary transfer roller 33 is disposed in the secondary transfer section T2. The secondary transfer roller 33 can move substantially in the vertical direction. At the time of image transfer, the secondary transfer roller 33 is pressed against the intermediate transfer member 38 with a predetermined pressure, via the recording medium P. Simultaneously therewith, bias is applied to the secondary transfer roller 33, and the toner image on the intermediate transfer member 38 becomes transferred to the recording medium P.

The intermediate transfer member 38 and the secondary transfer roller 33 are each driven, and hence the recording medium P nipped between the intermediate transfer member 38 and the secondary transfer roller 33 is transported in the direction of the left arrow in FIG. 5 at a predetermined transport speed V; the recording medium P is then further transported, by a transport belt 34, to the fixing unit 35 which is a subsequent process. In the fixing unit 35, the transferred toner image is fixed on the recording medium P through application of heat and pressure. The recording medium P is then discharged onto a discharge tray 37, on the top face of the apparatus, by discharge roller pairs 36.

One aspect of the present disclosure allows obtaining a pressing rotating member that is capable of exhibiting, at a high level, both surface layer durability and excellent thermal insulation. Another aspect of the present disclosure allows obtaining a fixing apparatus that contributes to shortening the first print out time. Yet another aspect of the present disclosure allows obtaining an image forming apparatus having a shorter first print out time than conventional apparatuses. A further aspect of the present disclosure allows achieving a method for producing a pressing rotating member that is capable of exhibiting, at a high level, both surface layer durability and excellent thermal insulation.

EXAMPLES

The present disclosure will be explained in concrete terms on the basis of examples. The present disclosure is not limited to the following examples. Unless particularly noted otherwise, units of parts in the examples and comparative examples refer to a mass basis in all instances.

In the present example a pressing rotating member was produced using the fluororesins and perfluoropolyethers below.

(Fluororesin)

PFA-1: "959HP-Plus" (product name, by Chemours-Mitsui Fluoroproducts Co., Ltd., melting point 296° C.)

PFA-2: "451HP-J" (product name, by Chemours-Mitsui Fluoroproducts Co., Ltd., melting point 305° C.)

(Perfluoropolyether)

PFPE-1: "Krytox GPL104" (product name, by The Chemours Company, viscosity 111 mPa·s (40° C.))

PFPE-2: "Krytox GPL105" (product name, by The Chemours Company, viscosity 301 mPa·s (40° C.))

PFPE-3: "Krytox GPL103" (product name, by The Chemours Company, viscosity 54 mPa·s (40° C.))

Example 1

Preparation of a Layered Body

Firstly, a sandblasted-surface iron substrate having a diameter of 23 mm was prepared as a base layer. The outer periphery of the above substrate was spray-coated, to a dry thickness of 3 with an addition-curable liquid silicone rubber (product name: DY35-051 A & B; equal mixture of "Liquid A" and "Liquid B", by Dow Corning Toray Co., Ltd.), followed by baking for 30 minutes at a temperature of 150° C.

Then 50 parts by mass of Liquid A (main agent) and 50 parts by mass of Liquid B (curing agent) of an addition-curable liquid silicone rubber (product name: DY35-1349SC, by Dow Corning Toray Co., Ltd.) (volume resistance value $10^5\Omega\cdot$cm) ware cast into a molding mold having an inner diameter of 30 mm and on the center of which the above iron substrate was fitted, and the mold was heated at a temperature of 150° C. for 1 hour, to elicit primary vulcanization, after which the product was demolded from the mold, to form an elastic layer on the outer peripheral surface of the substrate.

The outer peripheral surface of the elastic layer was coated with an addition-curable silicone rubber adhesive (product name: SE1819CV, by Dow Corning Toray Co., Ltd.; equal mixture of "Liquid A" and "Liquid B"), to an average thickness of 5 μm.

Next, a tube of PFA-1 shaped to a thickness of 20 μm by extrusion molding was applied, and the tube surface was squeezed uniformly, to thereby remove excess adhesive from between the elastic layer and the fluororesin tube. The base layer coated with the elastic layer and the surface layer was then placed in an electric furnace set to at a temperature of 200° C., and the whole was heated for 4 hours, to elicit curing of the adhesive and bonding of the tube onto the elastic layer, and yield thereby Layered body A1.

Production of a Pressing Rotating Member

Impregnation Step

PFPE-1 was placed in a graduated cylinder made of borosilicate glass. A heating wire covered with a thermal insulation material was wound around the whole graduated cylinder, and the graduated cylinder was heated up to a temperature of 310° C. of the PFPE. The Layered body A1 was attached to a dipping device, the entire layered body was immersed in the heated PFPE, and the Layered body A1 was retrieved after 1 minute.

The amount of PFPE in the obtained PFA tube impregnated with PFPE was measured in accordance with the following method. Specifically, a multilayer sample of the elastic layer and the resin layer was cut out from the layered body. The multilayer sample was immersed in a silicone resin dissolving agent (product name: e-Solve 21RS, by Kaneko Chemical Co., Ltd.), to dissolve the silicone rubber in the elastic layer, as a result of which the elastic layer was removed from the multilayer sample, to prepare a measurement sample made up of only the entire thickness portion of the PFA tube. This measurement sample was measured using a thermogravimetric analyzer (TGA). The content ratio (mass %) of PFPE relative to the PFPE-containing resin layer was calculated under the measurement conditions below.

Instrument: TGA851 (by Mettler-Toledo International Inc.)

Atmosphere: air

Temperature: 425° C.

In a profile of measurement time-weight loss rate obtained on the basis of the above thermogravimetric analysis, a linear least squares approximation expression was worked out from the region at which the slope was constant and at which only PFA decreased; the intercept of the linear least squares approximation expression was taken as the PFA amount (mass %), and the PFPE content was calculated as PFPE content (mass %)=100-PFA amount).

Pore Formation Process

Thereafter, Layered body A1 was placed in a graduated cylinder that held a fluorosolvent (product name: Novec 7300, by The 3M Company) having a hydrofluoroether structure and prepared separately, and the graduated cylinder was then set in a water bath of an ultrasonic application device (product name: Bransonic (model 2510J-DTH); by Emerson Japan, Ltd.), and was irradiated with ultrasounds for 60 minutes. After the treatment, the layered body was retrieved from the graduated cylinder and was dried by being allowed to stand in an environment at a temperature of 25° C. for 60 minutes. The PFPE present on the surface and the interior of the surface layer of Layered body A1 was removed in this manner, to yield a pressing rotating member according to the present example. The visual appearance of the obtained layered body was white, and it was found that pores had formed in the resin layer.

Three sets of measurement samples used for measuring the physical properties below were prepared as follows.

Preparation of Measurement Samples

The substrate was detached from the pressing rotating member, to obtain a Layered body B1 of the elastic layer and the surface layer. The Layered body B1 was immersed in a silicone resin dissolving agent (product name: e-Solve 21RS, by Kaneko Chemical Co., Ltd.), to dissolve the silicone rubber in the elastic layer, as a result of which the elastic layer was removed from the Layered body B1, to prepare a measurement sample that included the entire thickness portion of the surface layer.

Orientation (Degree of Orientation f and Orientation Angle Φ) of the Pores in the Surface Layer From the pressing rotating member there was cut out a sample using a section preparation device (for instance a Cryo-Ultra-microtome (product name: by Leica Microsystems GmbH)), so that a cross section in the thickness of the surface layer—the longitudinal direction of the pressing rotating member appeared on the surface of the sample. The above cross section was observed then under a scanning electron microscope, to acquire a respective image (SEM image) of a rectangular observation region that was 8 μm long×11 μm wide, at a predetermined position in the cross section. Image acquisition was adjusted so that the longitudinal direction of the image was parallel to the thickness direction of the surface layer, and the transversal direction of the image was parallel to the longitudinal direction of the pressing rotating member.

This SEM image from the cross section was acquired at the three locations below. Specifically, a position such that the upper end of the observation region is positioned at 1 μm in the depth direction of the surface layer, from the outer surface thereof, constituting the outer surface of the pressing rotating member which in turn constitutes the contact surface with the heating rotating member within the fixing apparatus; a position such that the lower end of the observation region is positioned at 1 μm from the surface of the surface layer on the reverse side from that of the outer surface (i.e. from the surface on the side facing the base layer), towards the outer surface; and a position at which the central portion of the surface layer in the thickness direction matches the center of the observation region. In a case where the thickness of the surface layer was smaller than 26 μm, the acquisition position was adjusted so that the observation regions did not overlap with each other.

Each obtained SEM image was binarized using numerical calculation software (product name: MATLAB; by The MathWorks, Inc.) to allow discriminating between two regions respectively corresponding to a resin portion and a pore portion. The binarization process relied on Otsu's method. Two-dimensional Fourier transform analysis was then performed, using the above numerical value calculation software, on the obtained binarized image obtained as a result of the binarization process, and the power spectrum was integrated in each direction, to obtain a plot diagram representing the degree and direction of orientation of the pores. The degree of orientation and the angle of orientation were calculated from the plot diagram, and arithmetic mean values thereof were taken as the degree of orientation f and the orientation angle Φ.

Ratio of Pores in the Surface Layer

From each binarized image above there was calculated a pore area ratio on the basis of the ratio of the number of pixels in the portion corresponding to the pores relative to the total number of pixels in the observation region.

Evaluation 1: Thermal Conductivity in the Thickness Direction of the Surface Layer The thermal conductivity λ, of the surface layer in the thickness direction was calculated on the basis of the following expression.

$$\lambda=\alpha\times C_p\times\rho$$

In the expression, λ is the thermal conductivity (W/(m·K)) of the surface layer in the thickness direction, a is the thermal diffusivity ($m^2/s$) in the thickness direction, $C_p$ is the constant-pressure specific heat (J/(kg·K)) and p is density ($kg/m^3$).

The values of the thermal diffusivity α in the thickness direction, the constant-pressure specific heat $C_p$ and the density p were worked out in accordance with the following methods.

Thermal Diffusivity α

The thermal diffusivity α of the surface layer in the thickness direction was measured as follows. A total of five sample pieces each having a surface area of 8 mm×12 mm were produced by being cut from the measurement sample using a cutter. The thickness of each sample piece was measured using a digital length measuring instrument (product name: DIGIMICRO MF-501, flat stylus, φ4 mm, by Nikon Corporation). Each sample piece was next measured a total of 5 times at room temperature (25° C.) using a thermal diffusivity measuring device relying on a periodical heating method (product name: FTC-1, by ADVANCE RIKO, Inc.), and the average value ($m^2/s$) of the five measurements was worked out. The measurements were performed while under pressing of the sample piece using a 1 kg weight.

The thermal diffusivity α of the surface layer in the thickness direction proved as a result to be $4.66\times10^{-8}$ $m^2/s$.

Constant Pressure Specific Heat $C_p$

The constant-pressure specific heat $C_p$ of the surface layer was measured using a differential scanning calorimeter (product name: DSC823e, by Mettler-Toledo International Inc.).

Specifically, an aluminum pan was used as the sample pan and as the reference pan. In a blank measurement first, a measurement was carried out according to a program in which both empty pans were held for 10 minutes at a constant temperature of 15° C., after which the pans were warmed up to 215° C. at a ramp rate of 10° C./minute, and were held at 215° C. for a further 10 minutes.

Next, 10 mg of synthetic sapphire of known constant-pressure specific heat were used as a reference substance, and a measurement was carried out using the same program. Next, a 10 mg measurement sample, i.e. the same amount as that of the synthetic sapphire of the reference substance, was cut out from the measurement sample above, was set on the sample pan, and a measurement was carried out in accordance with the same program.

The measurement results were analyzed using specific heat analysis software ancillary to the above differential scanning calorimeter, and the constant-pressure specific heat $C_p$ at 25° C. was calculated on the basis of the average values of the five measurement results.

The constant-pressure specific heat $C_p$ of the surface layer proved to be 1002.80 J/(kg·K).

Density ρ

The density ρ of the surface layer was measured using a dry automatic densitometer (product name: Accupic 1330-01, by Shimadzu Corporation).

Specifically, a 10 $cm^3$ sample cell was used, and a sample piece was cut out from the measurement sample above so as to fill up about 80% of the cell volume, whereupon the sample piece, after measuring of the mass thereof, was placed in the sample cell. The sample cell was set in a measuring section in the device, and after gas replacement using helium as the measurement gas, a volume measurement was carried out 10 times. The density of the surface layer was calculated from the mass of the sample piece and from each measured volume, and the average value was calculated.

The density ρ of the surface layer was as a result 1287.47 $kg/m^3$.

The calculation result of the thermal conductivity λ, of the surface layer in the thickness direction, on the basis of the unit-converted constant-pressure specific heat $C_p$ (J/(kg·K)) and density ρ ($kg/m^3$), and on the basis of the measured thermal diffusivity a ($m^2/s$), was herein $6.01\times10^{-2}$W/(m·K).

Evaluation 2: Measurement of the Tensile Yield Stress of the Surface Layer

Each measurement sample above was cut into a width of 5 mm and a length of 20 mm, to produce a respective tensile test piece. The test piece was set on a tensile measurement jig of a dynamic viscoelasticity measuring device (product name: Reogel-E4000, by UBM Co.) so that the chuck distance was 10 mm. A torque driver was used to fix the test piece to the jig, so that the tightening torque of the test piece was 5 cN·m.

The S-S curve in the tensile test was measured until the test piece broke, under conditions of temperature: 200° C. and tensile speed: 0.055 m/sec. In the measurement, only the data for fracture between the chucks was considered, and the measurement result was taken from the average value of the five measurements. An approximate line was drawn, with strain 0% to 3% of the S-S curve as a straight line, and the stress value at the intersection between the S-S curve and a straight line resulting from moving the approximate curve in the positive direction by a strain of 5% was taken as the value of tensile yield stress.

Evaluation 3: Evaluation of First Print Out Time

The produced pressing rotating member was mounted on the fixing apparatus illustrated in FIG. 4, with the pressing force applied between the fixing member and the pressing rotating member set to 20 kgf. The ceramic heater 17 of the fixing apparatus began being energized at 1200 W, and the time until the surface temperature of the fixing member reached 200° C., which was a temperature allowing for fixing in the fixing apparatus, was measured and taken as the first print out time.

Evaluation 4: Evaluation of Durability

The following durability test was performed on the pressing rotating member, in order to evaluate the wear resistance of the surface layer. Firstly, the produced pressing rotating member was fitted to the fixing apparatus having the configuration illustrated in FIG. 4. This fixing apparatus was built into a laser beam printer capable of high-speed fixing of 60 prints/minute (process speed 350 mm/sec), and then 5000 sheets of A4 size paper were continuously run in a continuous paper-passing mode. The surface temperature of the fixing belt at the time of fixing was set to 200° C., and the paper was run in an environment at a temperature of 15° C. and humidity of 20%. The pressing rotating member was removed after continuous paper running, and the surface of the pressing rotating member was observed visually and was evaluated according to the criteria below.

Rank "A": No cracks found in the surface layer.

Rank "B": Cracks observed in the surface layer.

Examples 2 to 12

Pressing rotating members 2 to 12 according to respective experimental examples were produced in the same way as in Example 1, but modifying herein, as given in Table 1, the PFA resin and thickness of the fluororesin tube used in the surface layer, the type of PFPE for impregnation, and the PFPE temperature at the time of contact.

Example 13

In the method described in Example 1 an iron substrate having a PFA resin (PFA-1) layered thereon was subjected to an annealing treatment at 330° C. for 30 minutes, to obtain a layered body. Thereafter, a pressing rotating member having undergone an impregnation step and a pore formation step was produced in the same way as in Example 1, to yield Pressing rotating member 13 according to the present example.

Comparative Example 1

A pressing rotating member was produced as in the method described for Example 1, up to laying of the PFA resin; the resulting member was Pressing rotating member C-1 according to the present comparative example.

Comparative Examples 2 to 4

Pressing rotating members C-2 to 4 according to respective comparative examples were produced in the same way as in Comparative example 1, but herein the thickness of the PFA resin that was laid in the method described for Comparative example 1 was modified as given in Table 1.

Comparative Example 5

A coating a material was prepared in the form of a mixture of 65 parts of small hollow spherical particles (product name: Glass Bubbles iM30K; by The 3M Company) in 100 parts of an aqueous coating material containing perfluoroethylene-propylene copolymer (product name: EJ-CL500; by Chemours-Mitsui Fluoroproducts Co., Ltd.).

An elastic layer and an adhesive layer were formed on an iron substrate in the same way as in Example 1. Next, the coating material prepared above was spray-coated onto the surface of the adhesive layer, so that the film thickness after baking was 20 μm. The whole was then baked at a temperature of 340° C. for 30 minutes, to produce Pressing rotating member C-5 according to the present comparative example.

Table 1 sets out the formulations and pore physical properties (pore ratio, degree of orientation f and orientation angle Φ) of the pressing rotating members produced in Examples 1 to 13 and Comparative examples 1 to 5. The surface layers of Pressing rotating members C-1 to C-4 according to Comparative examples 1 to 4 did not have pores, and therefore the physical properties of the pores were not measured.

TABLE 1

| | | Pressing rotating member No. | PFA Material type | PFA Melting point ° C. | PFA Thickness μm | PFPE Material type | PFPE Viscosity (40° C.) mPa · s | PFPE Temperature at contact ° C. | PFPE Impregnation amount mass % | Pore physical characteristics: Pore ratio % | Pore physical characteristics: Degree of orientation f — | Pore physical characteristics: Orientation angle φ ° |
|---|---|---|---|---|---|---|---|---|---|---|---|---|
| Example | 1 | 1 | PFA-1 | 296 | 20 | PFPE-1 | 111 | 310 | 41 | 40 | 0.58 | 1 |
| | 2 | 2 | PFA-1 | 296 | 40 | PFPE-1 | 111 | 310 | 40 | 40 | 0.55 | 2 |
| | 3 | 3 | PFA-1 | 296 | 60 | PFPE-1 | 111 | 310 | 40 | 40 | 0.53 | 2 |
| | 4 | 4 | PFA-1 | 296 | 80 | PFPE-1 | 111 | 310 | 40 | 40 | 0.50 | 3 |
| | 5 | 5 | PFA-1 | 296 | 20 | PFPE-1 | 111 | 300 | 26 | 27 | 0.55 | 0 |
| | 6 | 6 | PFA-1 | 296 | 20 | PFPE-2 | 301 | 310 | 30 | 30 | 0.43 | 1 |
| | 7 | 7 | PFA-1 | 296 | 40 | PFPE-2 | 301 | 310 | 30 | 30 | 0.40 | 1 |
| | 8 | 8 | PFA-1 | 296 | 60 | PFPE-2 | 301 | 310 | 30 | 30 | 0.38 | 1 |
| | 9 | 9 | PFA-1 | 296 | 80 | PFPE-2 | 301 | 310 | 30 | 30 | 0.35 | 2 |
| | 10 | 10 | PFA-1 | 296 | 20 | PFPE-2 | 301 | 300 | 27 | 27 | 0.41 | 0 |
| | 11 | 11 | PFA-1 | 296 | 20 | PFPE-3 | 54 | 310 | 45 | 45 | 0.55 | 2 |
| | 12 | 12 | PFA-2 | 305 | 20 | PFPE-1 | 111 | 320 | 27 | 28 | 0.40 | 1 |
| | 13 | 13 | PFA-1 (annealed) | 296 | 20 | PFPE-1 | 111 | 310 | 40 | 40 | 0.26 | 7 |
| Comparative example | 1 | C-1 | PFA-1 | 296 | 20 | — | — | — | — | — | — | — |
| | 2 | C-2 | PFA-1 | 296 | 40 | — | — | — | — | — | — | — |
| | 3 | C-3 | PFA-1 | 296 | 60 | — | — | — | — | — | — | — |
| | 4 | C-4 | PFA-1 | 296 | 80 | — | — | — | — | — | — | — |
| | 5 | C-5 | PFA coating material + hollow particles | — | 20 | — | — | — | — | 54 | 0.15 | 6 |

In Table 1, the term "pore ratio" denotes the area ratio (%) taken up by the pores in the surface layer.

Table 2 sets out evaluation results of Evaluations 1 to 4 of the pressing rotating members produced in Examples 1 to 13 and Comparative examples 1 to 5.

TABLE 2

| | | Pressing rotating member No. | Physical characteristics of surface layer: Thermal conductivity in the thickness direction $\times 10^{-2}$ W/(m · K) | Physical characteristics of surface layer: Tensile yield stress Mpa | Evaluation of pressing rotating member: First print out time Seconds | Evaluation of pressing rotating member: Durability evaluation Rank |
|---|---|---|---|---|---|---|
| Example | 1 | 1 | 6.01 | 12.1 | 6.9 | A |
| | 2 | 2 | 6.31 | 12.3 | 6.6 | A |
| | 3 | 3 | 6.23 | 11.9 | 6.4 | A |
| | 4 | 4 | 6.53 | 12.2 | 6.3 | A |
| | 5 | 5 | 8.50 | 14.6 | 7.0 | A |
| | 6 | 6 | 8.16 | 14.0 | 7.0 | A |
| | 7 | 7 | 8.26 | 13.9 | 6.8 | A |
| | 8 | 8 | 8.54 | 14.1 | 6.7 | A |
| | 9 | 9 | 8.90 | 14.2 | 6.6 | A |
| | 10 | 10 | 9.32 | 15.6 | 7.0 | A |
| | 11 | 11 | 6.05 | 12.1 | 6.9 | A |
| | 12 | 12 | 8.64 | 14.4 | 7.0 | A |
| | 13 | 13 | 9.46 | 14.0 | 7.0 | A |
| Comparative example | 1 | C-1 | 17.02 | 19.5 | 9.6 | A |
| | 2 | C-2 | 17.02 | 19.3 | 9.5 | A |
| | 3 | C-3 | 17.02 | 19.3 | 9.4 | A |
| | 4 | C-4 | 17.02 | 19.3 | 9.3 | A |
| | 5 | C-5 | 6.93 | 7.0 | 6.9 | B |

Table 2 reveals that the pressing rotating members of the examples exhibited excellent thermal conductivity, and no cracks occurred in the members even after prolonged use. As a result, it was found that the pressing rotating members of the examples allow shortening the first print out time while preserving durability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-217926, filed Dec. 25, 2020, and Japanese Patent Application No. 2021-194429, filed Nov. 30, 2021, which are hereby incorporated by reference herein in their entirety.

What is claimed is:

1. A pressing rotating member comprising a base layer, an elastic layer and a surface layer, in this order, the surface layer having pores, wherein when placing an observation region 8 μm long×11 μm wide at a cross section of the surface layer in a thickness direction of the surface layer—a direction perpendicular to a circumferential direction of the pressing rotating member, and defining a degree of orientation of the pores observed in the observation region as f, and an orientation angle of the pores observed in the observation region as Φ, f and Φ satisfy the following relationships:

f is 0.20 or higher;

Φ is 0° to 10°.

2. The pressing rotating member according to claim 1, wherein an area ratio taken up by the pores in the region is 15% to 50%.

3. The pressing rotating member according to claim 1, wherein a thickness of the surface layer is 12 to 100 μm.

4. The pressing rotating member according to claim 1, wherein the surface layer comprises a fluororesin.

5. The pressing rotating member according to claim 1, wherein the surface layer comprises a copolymer of tetrafluoroethylene and a perfluoroalkyl vinyl ether.

6. The pressing rotating member according to claim 5, wherein a melting point of the copolymer is 280 to 320° C.

7. The pressing rotating member according to claim 1, wherein the pressing rotating member has an endless belt shape.

8. The pressing rotating member according to claim 1, wherein the pressing rotating member has a roller shape.

9. A fixing apparatus comprising a pressing rotating member, a fixing belt, and heating means of the fixing belt, wherein the pressing rotating member has a base layer, an elastic layer and a surface layer, in this order, the surface layer has pores, when placing an observation region 8 μm long×11 μm wide at a cross section of the surface layer in a thickness direction of the surface layer—a direction perpendicular to a circumferential direction of the pressing rotating member, and defining a degree of orientation of the pores observed in the observation region as f, and an orientation angle of the pores observed in the observation region as Φ, f and Φ satisfy the following relationships:

f is 0.20 or higher;

Φ is 0° to 10°.

10. An electrophotographic image forming apparatus, comprising the fixing apparatus according to claim 9.

* * * * *